United States Patent [19]

Gold

[11] Patent Number: 5,016,372

[45] Date of Patent: May 21, 1991

[54] ROAD SERVICE SIGN

[75] Inventor: Albert A. Gold, Santa Monica, Calif.

[73] Assignee: GBD Inc. dba Gold Graphics, Pacoima, Calif.

[21] Appl. No.: 450,835

[22] Filed: Dec. 14, 1989

[51] Int. Cl.[5] ..... G09F 21/04

[52] U.S. Cl. ..... 40/591; 40/604; 40/607; 40/610; 116/173

[58] Field of Search ..... 40/591, 604, 603, 617, 40/607, 606, 612, 610, 611, 479; 116/28 R, 173; 248/121

[56] References Cited

U.S. PATENT DOCUMENTS

| | | | |
|---|---|---|---|
| 1,294,032 | 2/1919 | Bixby | 116/173 |
| 1,728,079 | 9/1929 | Power | 40/479 |
| 2,527,357 | 10/1950 | Donahey | 116/173 |
| 2,732,823 | 1/1956 | Hanson | 116/173 |
| 2,914,874 | 12/1959 | Stein | 40/617 |
| 3,030,718 | 4/1962 | Kirkman | 40/617 |
| 3,775,887 | 12/1973 | Precourt | 40/603 |
| 4,375,134 | 3/1983 | Sheetz | 40/610 |

FOREIGN PATENT DOCUMENTS

| | | | |
|---|---|---|---|
| 486679 | 7/1928 | Fed. Rep. of Germany | 116/173 |

*Primary Examiner*—Kenneth J. Dorner
*Assistant Examiner*—J. Hakomaki
*Attorney, Agent, or Firm*—Spensley, Horn, Jubas & Lubitz

[57] ABSTRACT

A sign for attaching to a vehicle. In the illustrated embodiment, a flexible sign requesting road service has a sleeve which allows the sign to be readily attached to the antennae of the vehicle. A second sleeve receives a stiffening member to ensure the readability of the sign. When not in use, the sign may be readily folded or rolled for compact storage.

8 Claims, 1 Drawing Sheet

10
16
18
20
50
52
3
2
40
42
14
12
36
15
ROAD
SERVICE
REQUIRED 18
20
16
50
14
32
30
12

12
14
36
60
40
42
62
36

ROAD SERVICE SIGN

BACKGROUND OF THE INVENTION

1. Field of the Invention.

The present invention relates to signs, and more particularly to signs for use with vehicles.

2. Description of Related Art.

For the occasions when a motorist experiences mechanical difficulties sufficiently serious to necessitate stopping the vehicle before a service station can be reached, a number of devices have been proposed by which the motorist can signal that road assistance is requested. For example, cardboard window shades that are placed on the dashboard of the vehicle may have a message such as "call police" imprinted on one side of the shade. However, the message often is not easily viewed from some directions, particularly from the rear of the vehicle.

Other signalling devices include flags or ribbons which attach in some manner to the radio antennae of the vehicle. However, many of these devices require a wind to be blowing to extend the flag horizontally for maximum visibility. Various law enforcement agencies also place inverted envelopes over the end of the antennae of disabled vehicles. However, these envelopes tend to be relatively small in size and therefore limited in visibility.

SUMMARY OF THE INVENTION

It is an object of the present invention to provide an improved sign for vehicles, obviating for practical purposes the above-mentioned limitations, particularly in a manner requiring a relatively uncomplicated mechanical arrangement.

These and other objects and advantages are achieved in a sign having, in accordance with the illustrated embodiment of the present invention, an elongated member and a flexible sheet having a first sleeve for receiving a vehicle antennae so that the sign may be supported by the antennae, and a second sleeve adapted to receive the elongated member to stiffen the sign adjacent to the member. Such an arrangement has been found to provide a sign having very good visibility, whether or not any wind is present. In addition, various messages may be imprinted on the sign and these messages, because of the construction of the sign, are readily readable even if wind is not present.

DETAILED DESCRIPTION OF THE DRAWINGS

Figure 1:
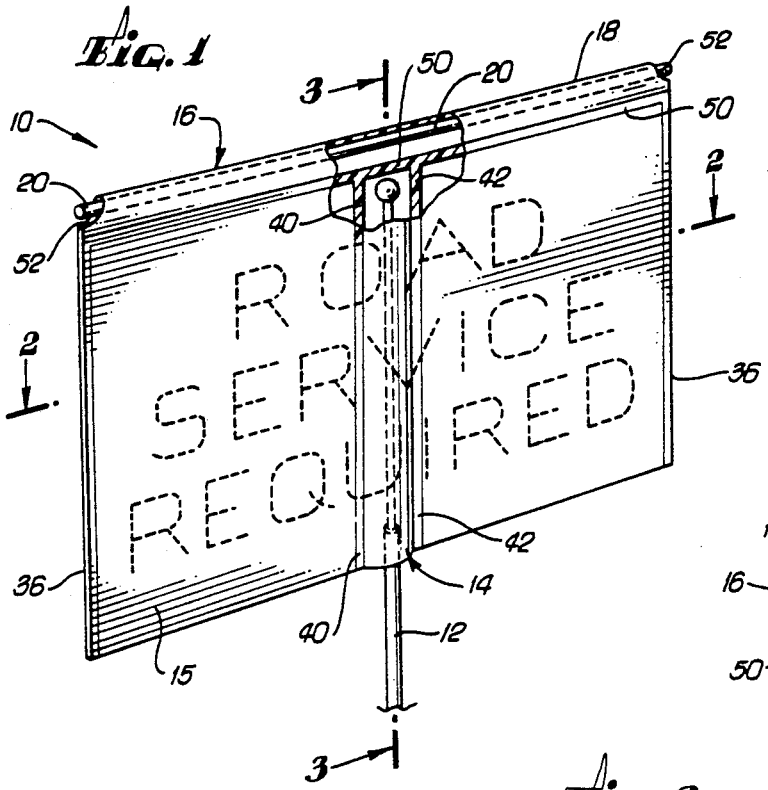
FIG. 1 is a perspective view of a vehicle sign in accordance with a preferred embodiment of the present invention.

A vehicle sign in accordance with a preferred embodiment of the present invention is indicated generally at 10 in FIG. 1. In the illustrated embodiment, the sign 10 is in the form of a banner which may be fitted over the top of the vehicle's antennae 12 once the vehicle has been stopped because of mechanical difficulties. Imprinted on both the front and back surfaces of the sign 10 is an appropriate message such as "Road Service Required" or the like. Alternatively, the logo or other service marks of a particular emergency road service company might be imprinted as well. Passing motorists upon seeing the sign 10 displayed on a disabled vehicle can report the vehicle's location to the police or to the appropriate emergency road service company.

Figure 3:
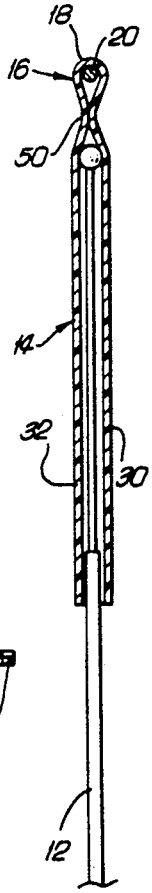
FIG. 3 is a cross-sectional view of the sign of FIG. 1 as viewed along the lines 3—3.
Figure 2:
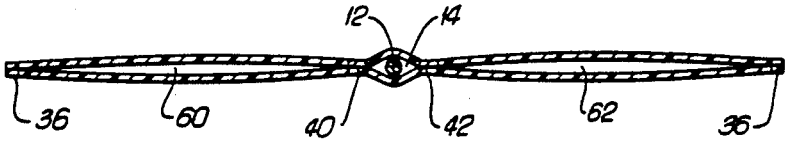
FIG. 2 is a cross-sectional view of the sign of FIG. 1 as viewed along the lines 2—2.

In one aspect of the present invention, the sign 10 includes a first sleeve 14 which receives the vehicle antennae 12 as shown in FIGS. 1–3. Preferably the sleeve 14 is sized sufficiently to receive the vehicle antennae 12 loosely within the sleeve 14 as best seen in FIG. 2. In this manner, the sign 10 may be quickly and easily mounted on the antennae 12 should emergency assistance be required. Moreover, the sleeve 14 is sufficiently long (approximately 10 inches in the illustrated embodiment) to retain the sign securely on the antennae 12 until the sign is no longer needed.

The sign 10 is preferably fabricated from a sheet 15 of flexible material such as, for example, plastics or fabrics. Such an arrangement allows the sign 10 to be compactly stored until needed. In a second aspect of the present invention, the sign 10 has a second sleeve 16 which, in the illustrated embodiment, is positioned across the top edge 18 of the sign 10 and transverse to the first sleeve 14. The second sleeve 16 receives a stiffening member such as a wooden dowel 20 which maintains the top edge 18 erect to ensure readability of the printed message while the sign is mounted on the antennae. Thus, the sign 10, unlike a typical flag, does not rely upon the wind to unfurl the message bearing surface so that the message can be read.

Once the sign 10 is no longer needed, the sign 10 may be conveniently rolled up around the dowel 20 for storage. Alternatively, the dowel 20 may be removed to allow the sign 10 to be folded into a compact square.

In the illustrated embodiment, the sheet 15 of flexible material is a polyethylene plastic. It is recognized of course that a variety of materials may be used including stiff materials such as cardboard. The sheet 15 is folded in half to define two half sheets 30 and 32 (FIG. 3) which have the folded edge 18 in common at the top of the sign 10. The side edges of the half sheets 30 and 32 are heat-bonded together along their lengths as indicated at 36. Fastening techniques other than heat-bonding may also be used such as glue, for example.

The first sleeve 14 is formed in the center of the sign 10 by heat-bonding the two half-sheets together along two centrally located parallel seams 40 and 42 which are in turn parallel to the side edges 36. The seams 40 and 42 are spaced sufficiently so that the central sleeve 14 can loosely receive the vehicle antennae 12 as shown in FIG. 2. The second sleeve 16 is formed by heat-bonding the two half-sheets together along another seam 50 parallel to but spaced from the folded top edge 18. The top corners 52 of the sign 10 are clipped to provide openings at the ends of the sleeve 16 to allow the dowell 20 to be readily inserted and removed from the top sleeve 16 as desired. As best seen in FIG. 3, the top of the antennae 12 engages the top seam 50 when inserted into the central sleeve 14.

In another aspect of the present invention, the central seam 40 and the associated side edge seam 36 define another sleeve 60 which is to one side of and substantially larger than the central sleeve 14. Many vehicles do not have an external pole-type antennae adapted to be inserted into the central sleeve 14. For such vehicles, the side sleeve 60 may be readily affixed to other protruding portions of the vehicle such as a rear view side mirror, for example. The second seam 42 of the central sleeve 14 together with the other side seam 36 similarly define a second side sleeve 62 for attaching the sign 10 to the vehicle.

It is seen from the above that the present invention provides a unique sign for vehicles, which can be easily attached to a vehicle when needed yet is inexpensive to manufacture and may be compactly stored. It will, of course, be understood that modifications of the present invention, in its various aspects, will be apparent to those skilled in the art, some being apparent only after study and others being matters of routine mechanical design. For example, the sign 10 may have a shape other than the rectangular shape illustrated.

Other embodiments are also possible, their specific designs depending upon the particular application. As such, the scope of the invention should not be limited by the particular embodiment herein described but should be defined only by the appended claims and equivalents thereof.

What is claimed is:

1. A sign for requesting road service, comprising:

a sheet having a vertical sleeve and a horizontal sleeve, said vertical sleeve being located in the interior of the sign and sized sufficiently to receive an upper portion of a vehicle antennae and said horizontal sleeve being located across the top of the sheet; and a stiffening member adapted to be received in said horizontal sleeve;

said sheet bearing indicia representative of a message relating to road service.

2. The sign of claim 1 wherein the vertical sleeve is centrally located on the sign.

3. The sign of claim 1 wherein the sleeve are formed by heat-bonding portions of the flexible sheet together.

4. The sign of claim 1 further comprising at least one additional sleeve adjacent to the vertical sleeve.

5. A banner for road service, comprising:

a polyethylene sheet folded in half to define two half-sheets, each half-sheet having a folded edge in common with the other half-sheet, a free edge opposite the folded edge, and a pair of side edges heat-bonded to the corresponding side edges of the other half-sheet, said half-sheets further being selectively heat-bonded together to define a pair of heat-bonded seams in a central portion of the half-sheets to thereby define a sleeve between the central seams, said sleeve having sufficient width to receive a vehicle antennae, said half-sheets further being selectively heat bonded together to define a third heat-bonded seam, said third seam being positioned adjacent to but spaced from the folded edge of the half-sheets to define a second sleeve between the third seam and the folded edge;

a stiffening member adapted to be inserted into the second sleeve to stiffen the folded edge of the banner; and indicia imprinted on the sheet, said indicia representing a message relating to road service for a vehicle.

6. A sign for attaching to a vehicle, comprising:

an elongated member; and a flexible sheet having a vertical sleeve located in the interior of the sign for receiving a protruding portion of the vehicle so that the sign may be supported by the vehicle, and a horizontal sleeve located across the top of the sheet adapted to receive the elongated member to stiffen the sign adjacent to the member.

7. The sign of claim 6 wherein the vertical sleeve is centrally located on the sign.

8. A sign for requesting road service, comprising:

a sheet having a vertical sleeve and a horizontal sleeve, said vertical sleeve being located in the interior of the sign and sized sufficiently to receive an upper portion of a vehicle antennae and said horizontal sleeve being located across the top of the sheet; and a stiffening member adapted to be received in said horizontal sleeve wherein the vehicle antennae in use supports said stiffening member received in said horizontal sleeve in a generally horizontal direction thereby stiffening the sign, said sheet bearing indicia representative of a message relating to road service.

* * * * *